United States Patent [19]

Masaki et al.

[11] Patent Number: 4,893,538

[45] Date of Patent: Jan. 16, 1990

[54] PARAMETER SUPPLY DEVICE IN AN ELECTRONIC MUSICAL INSTRUMENT

[75] Inventors: Kazuo Masaki; Mitsumi Kato, both of Hamamatsu, Japan

[73] Assignee: Yamaha Corporation, Hamamatsu, Japan

[21] Appl. No.: 19,528

[22] Filed: Feb. 26, 1987

[30] Foreign Application Priority Data

Feb. 28, 1986 [JP] Japan ..... 61-43035

[51] Int. Cl.[4] ..... G10H 1/06; G10H 1/46; G10H 7/00

[52] U.S. Cl. ..... 84/605; 84/622

[58] Field of Search ..... 84/1.1, 1.11, 1.19, 84/1.22, 1.27, 1.01, 1.28, DIG. 2

[56] References Cited

U.S. PATENT DOCUMENTS

| | | | |
|---|---|---|---|
| 4,467,690 | 8/1984 | Nishimoto | 84/1.27 X |
| 4,481,851 | 11/1984 | Swain et al. | 84/DIG. 2 X |
| 4,483,229 | 11/1984 | Tsukamoto et al. | 84/1.19 X |
| 4,539,884 | 9/1985 | Aoki | 84/1.19 X |
| 4,624,170 | 11/1986 | Ohno et al. | 84/1.19 X |
| 4,633,749 | 1/1987 | Fujimori et al. | 84/1.01 |
| 4,633,750 | 1/1987 | Sakai | 84/1.1 |
| 4,681,007 | 7/1987 | Nikaido et al. | 84/1.1 |

FOREIGN PATENT DOCUMENTS

| | | | |
|---|---|---|---|
| 0039615 | 3/1979 | Japan | 84/1.19 |
| 0197096 | 11/1984 | Japan . | |
| 0055398 | 3/1985 | Japan . | |

*Primary Examiner*—Stanley J. Witkowski

*Attorney, Agent, or Firm*—Spensley Horn Jubas & Lubitz

[57] ABSTRACT

Address memories storing address data, individually, for respective parameter determining factors (e.g., tone color kind, tone pitch, key touch or other factors) are provided for the respective parameter determining factors. Address data stored in at least one of these address memories is read out in accordance with a combination of the parameter determining factor corresponding to the address memory and data corresponding to at least another parameter determining factor. In other words, plural address memories corresponding to parameter determining factors (designated as first parameter determining factors) are provided with an address memory corresponding to another parameter determining factor (designated as a second parameter determining factor). One address memory is designated by data corresponding to a first parameter determining factor and address data is read out from this address memory in correspondence to the second parameter determining factor. Address data read out from respective address memories are operated by an operation circuit and an address signal corresponding to a combination of plural parameter determining factors is thereby formed. A set of parameters is read out from a parameter memory in response to this address signal.

11 Claims, 3 Drawing Sheets

PARAMETER SUPPLY DEVICE IN AN ELECTRONIC MUSICAL INSTRUMENT

BACKGROUND OF THE INVENTION

This invention relates to a parameter supply device for storing parameters determining characteristics of a tone such as waveshape data in a memory of an electronic musical instrument and reading out these parameters in accordance with plural parameter determining factors and, more particularly, to improvement in an address system for accessing the memory.

In a case where tone waveshapes of different characteristics are to be generated in accordance with plural tone color control factors (e.g., key touch, tone range or tone color selection information etc.), waveshapes of different characteristics are stored in a memory and these waveshapes are selectively read out in accordance with the tone color control factors. In a prior art device, the memory storing such waveshapes is directly accessed in accordance with the tone color control factors and, in this case, the following problem arises.

If the memory has a common construction for all combinations of control factors, there occurs waste of the memory capacity. If, for example, the adopted construction is such that waveshapes corresponding to key touch in N stages are stored for each tone range, the memory must have a capacity for storing waveshape data of N times of the number of the tone ranges. It is however unnecessary in some tone ranges to store waveshapes which are different for the respective key touches of the N stages and common waveshape data can be used for two stages or three stages in one tone range. In such case, there occurs waste in the memory construction in which N waveshape data are stored for each tone range because the same waveshape data are stored in duplication in some tone ranges.

If the memory construction is changed in accordance with the combination of the control factors, i.e., in such a case that common waveshape is stored for key touches of every two stages in some tone ranges, other common waveshape data is stored for key touches of every three stages in other tone ranges and waveshape data which is different for each stage of key touch is stored in still other tone ranges, waste of the memory capacity can be avoided. In this case, however, an address generation circuit must be constructed in such a manner that it can generate proper address signals for all combinations of the control factors which results in a very complex circuit construction. Besides, the change in the memory construction must be accompanied by change in the hardware construction of the entire address generation circuit and this involves a troublesome change in the circuit design.

SUMMARY OF THE INVENTION

It is, therefore, an object of the invention to propose an address system capable of eliminating the above described waste in the memory construction and also simplifying the construction of the address generation circuit and coping with the change in the circuit design with a minimum modification, and provide a parameter supply device capable of supplying parameters in accordance with such address system.

The parameter supply device according to the invention is characterized in that it comprises information generating means for generating first information and second information, a combination of said first information and said second information determining a characteristic of a tone to be produced by said electronic musical instrument, memory means for storing plural parameter each of which corresponds to said combination and represents said characteristic, said memory means being divided into plural locations each of which is specified by said combination and stores a parameter corresponding to said combination among said plural parameter, address generating means for storing plural addresses and for outputting a first address corresponding to said first information from among said plural addresses, calculation means for calculating said first address and said second information and for outputting a second address based on the calculation result, and read out means for reading out said parameter from the location designated by said second address, said characteristic being determined by the read out parameter.

According to this invention, for reading out a parameter representing a characteristic of a musical tone determined by a combination of first and second information from the memory means, the first and second information are not directly address inputted to the memory means but a first address corresponding to the first information is outputted from the address generating means, a second address is generated by calculating this first address and the second information and the parameter is read out from a location designated by this second address. By adopting such indirect address system, a minor change has only to be made in the address generating means in a case where the memory construction of the memory means has been changed so that it is unnecessary to change the hardware construction of the entire circuit.

A parameter supply device in another aspect of the invention is characterized in that it comprises parameter memory means for storing plural sets of parameters in correspondence to plural sets of combinations of parameter determining factors, address memory means provided for each of the parameter determining factors for storing address data individually in correspondence to each parameter determining factor, operation means for operating address data read out from the address memory means individually in correspondence to each parameter determining factor for forming an address signal corresponding to combination of these parameter determining factors and reading out a set of parameters from the parameter memory means in response to this address signal, address data stored in memory means in the address memory means corresponding to at least one parameter determining factor being read out in accordance with combination of the parameter determining factor and data corresponding to at least another parameter determining factor.

In the address memory means provided for each parameter determining factor, address data is stored individually for each parameter determining factor and, in the address memory means corresponding to at least one parameter determining factor, address data stored therein is read out in accordance with combination of this parameter determining factor and data corresponding to at least another parameter determining factor. The address data read out from the address memory means individually in correspondence to each parameter determining factor is operated by the operation means whereby an address signal corresponding to combination of these parameter determining factors is formed by the operation means. A set of parameters is read out from the parameter memory means in response to this address signal.

According to the invention in which, in sum, address data is read out individually in accordance with each parameter determining factor, an address signal is formed by operating this address data and a set of parameters corresponding to combination of the respective parameter determining factors in accordance with this address signal, the memory construction for the parameter memory means can be changed in accordance with combination of the parameter determining factors so that waste of the memory can be avoided. Since the address system adopted in the invention is an indirect address system in which the address signal for reading out a parameter is formed on the basis of address data stored in correspondence to each parameter determining factor, data stored in necessary position in the address memory means has only to be changed if the memory construction of the parameter memory means is to be changed and it is unnecessary to change the hardware construction of the entire circuit. Further, in the memory means corresponding to at least one parameter determining factor, an address system in hierarchy is adopted, i.e., address data stored therein is read out in accordance with combination of that parameter determining factor and at least another parameter determining factor and, accordingly, change in the construction of the parameter memory means can be coped with by a minimum modification in the address memory means so that the device can enjoy a high degree of freedom in changing data.

An embodiment of the invention will now be described with reference to the accompanying drawings

BRIEF DESCRIPTION OF THE DRAWINGS

In the accompanying drawings.

DESCRIPTION OF PREFERRED EMBODIMENTS

Figure 1:
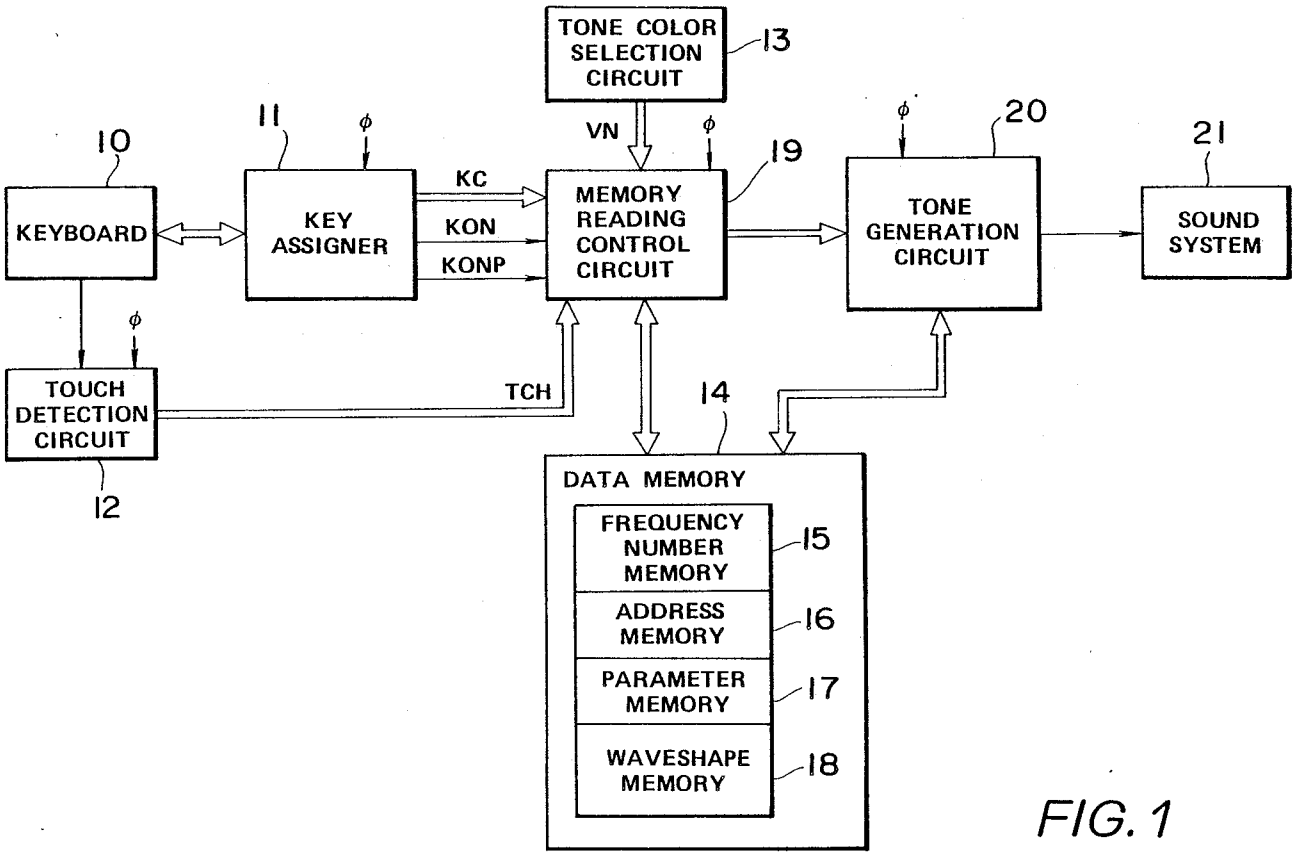
FIG. 1 is a block diagram showing the entire construction of an electronic musical instrument incorporating an embodiment of the invention.

Referring to FIG. 1, a key assigner 11 detects a key depressed in a keyboard 10 and assigns sounding of the depressed key to any of channels of a predetermined number (eight in the present embodiment). A key code KC of a key assigned to each channel, a key-on signal KON and a key-on pulse KONP are produced by the key assigner 11 on a time shared basis. A touch detection circuit 12 detects a key touch such as speed and force of depressing a key in the keyboard 10 and, upon detection of the key touch, produces touch data TCH. A tone color selection circuit 13 comprises operation elements for selecting a tone color and produces a tone color code VN representing a selected tone color. In this embodiment, there are three kinds of parameter determining factors, namely a tone color selected by the tone color selection circuit 13, a tone pitch (or a tone range) of a key depressed in the keyboard 10 and a key touch detected by the touch detection circuit 12.

A data memory 14 is a memory storing various data and includes, for example, a frequency number memory 15, an address memory 16, a parameter memory 17 and a waveshape memory 18. A memory reading control circuit 19 controls reading of the data memory 14 in accordance with data VN, TCH, KC, KON and KONP corresponding to the respective parameters and supplies parameter data necessary for forming a tone to a tone generation circuit 20. The tone generation circuit 20 generates a tone signal in accordance with parameter data supplied thereto. The circuit 20 generates a tone signal by, for example, controlling reading of the waveshape memory 18 and generation of an envelope shape in accordance with the parameter data supplied. A tone signal generated is supplied to a sound system 21.

Figure 2:
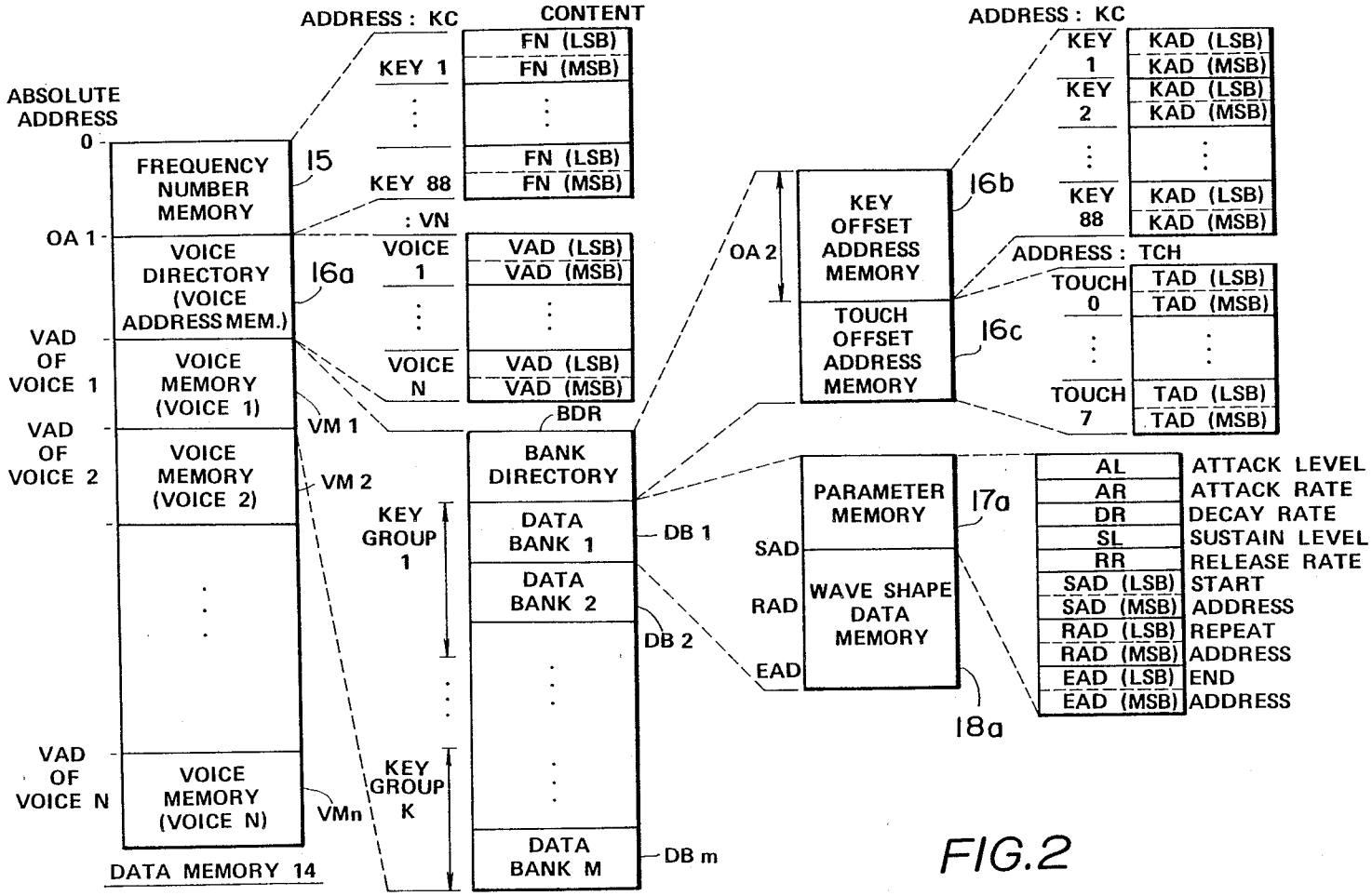
FIG. 2 is a diagram showing an example of a memory map of a data memory shown in FIG. 1.

An example of the data memory 14 will be described with reference to a memory map shown in FIG. 2.

The frequency number memory 15 stores, for each of keys, frequency number FN which is a constant corresponding to a tone frequency. The frequency number memory 15 produces a frequency number FN corresponding to a key code KC which is used as the address signal in this memory 15. This frequency number memory 15 occupies a storage area starting from absolute address 0 in the data memory 14.

A voice directory (voice address memory) **16*a* stores voice address data VAD corresponding to various tone colors (distinguished from each other by voices 1 - N). Using the tone color code VN, the voice directory 16*a* produces voice address data VAD corresponding to this tone color code VN. This voice directory 16*a* occupies a storage area starting from a predetermined offset address OA1 (absolute address) in the data memory 14**.

The remaining storage area of the data memory 14 is occupied by voice memories VM1 - VMn corresponding to the respective voices 1 - N. The voice address data VAD stored in the voice directory **16*a* is data which indicates initial addresses of the voice memories VM1 - VMn corresponding to the respective voices 1** - N in absolute addresses. Each of the voice memories VM1 - VMn includes a bank directory BDR and data bank DB1 - DBm of any desired number M (this M may differ voice from voice).

The bank directory BDR consists of a key offset address memory **16*b* and a touch offset address memory 16*c*. The key offset address memory 16*b* stores key offset address data KAD corresponding to respective keys and produces key offset address data KAD corresponding to a key code KC used as the address signal. The number of keys is, for example, 88. The touch offset address memory 16*c* stores touch offset address data TAD corresponding to respective stages of key touch and produces touch offset address data TAD corresponding to touch data TCH used as the address signal. The stages of key touch is, for example, eight stages for 0 to 7. In the bank directory BDR, the key offset address memory 16*b* is provided ahead of the touch offset address memory 16*c* and the initial address of the touch offset address memory 16*c* is offset by a predetermined offset address OA2 from the initial address of the bank directory BDR (this address is also the initial address of the key offset address memory 16*b***).

The data banks DB1 - DBm respectively store a set of parameters establishing characteristics of a tone. Bank groups 1-k consisting of desired number of banks correspond to key groups 1-k with each bank of one bank corresponding to the key touch. The key offset address data KAD is data indicating the initial address of initial bank in an object bank group in the data bank DB1-DBm by a relative address from the initial address of the bank directory BDR. The touch offset address data TAD is data indicating the initial address of an object bank in one bank group by a relative address from the initial bank of the bank group.

One data bank consists of a parameter memory 17*a* and waveshape data memory 18*a*. The parameter memory 17*a* corresponding to one bank stores a set of parameter data realizing specific tone characteristics. The set of parameter data consists of attack level data AL, attack rate data AR, decay rate data DR, sustain level data SL and release rate data RR used for determining characteristics of the envelope shape and start address data SAD, repeat address data RAD and end address data EAD used for reading out waveshape data from the waveshape data memory 18*a*. The waveshape data for realizing a specific tone color. During sounding of a tone, a tone signal is produced by reading first a waveshape of plural periods from a start address to an end address once and subsequently reading out a waveshape of plural periods from a repeat address to the end address repeatedly. The address data SAD, RAD and EAD are used for indicating the start address, repeat address and end address during this reading. Advancing of the waveshape reading phase is performed by repeated operation of the frequency number FN in a well known manner.

There are M data banks for each voice, each data bank storing a set of such parameters and there are N voices so that plural sets of parameters are stored as a whole. A set of parameters to be read out is determined in accordance with combination of the tone color code VN, key code KC and touch data TCH. In other words, one voice address data VAD is read out from the voice directory (voice address memory) 16*a* in accordance with the tone color code VN. One key offset address data KAD is read out, in accordance with the key code KC, from the key offset address memory 16*b* in the bank directory BDR in one of the voice memories (VM1-VMn) corresponding to the read out voice address data VAD and, likewise, one touch offset address data TAD is read out, in accordance with the touch data TCH, from the touch offset address memory 16*c*. One data bank is designated by the read out key offset address data KAD, touch offset address data TAD and the above described voice address data VAD and a set of parameters AL-AR, SAD, RAD and EAD are read out from the designate data bank.

As will be apparent form the above, since the key offset address memory 16*b* and the touch offset address memory 16*c* are provided for each voice, these memories 16*b* and 16*c* are virtually accessed in accordance with not only the key code KC or the touch data TCH but combination of such key code KC or touch data TCH and voice address data VAD corresponding to the tone color code VN. That is, the key offset address memory 16*b* and the touch offset address memory 16*c* are ranked in the lower order of the voice address memory 16*a* so that designation of the key group can be changed for the same key depending upon the voice (i.e., by changing the value of the key offset address data KAD) and the value of the touch offset address data TAD can be changed for the same key touch depending upon the voice.

In the order of the address, the voice address data VAD is ranked in the highest order, the key offset address data KAD in the next order and the touch offset address data TAD in the lowest order. If the specification of bank construction in the data bank has been changed, such change can be coped with by changing the contents of storage of the address memory of the lowest order.

The specification of data bank is not uniform. For example, in one tone range (key group) of one tone color (voice), eight different banks are prepared for all of eight stages of touch variations (in this case, different offset address data TAD are stored at address positions corresponding to respective touches 0-7 of the corresponding touch offset address memory 16*c*) whereas in another (or the same) tone range of another (or the same) tone color, only banks of a smaller number are prepared (in this case, offset address data TAD of the same value is in some case stored in address positions corresponding to respective touches 0-7 in the corresponding touch offset address memory 16*c*. Whatever the specification of the data bank may be, the hardware construction of the individual address memories 16*a*, 16*b* and 16*c* corresponding to respective parameter determining factors are standardized (the number of address positions being fixed) but various specifications may be prepared by suitably changing contents of the address data stored therein.

Since, in this embodiment, the frequency number FN stored in the frequency number memory 15, the address data VAD, KAD and TAD stored in the address memories 16*a*, 16*b* and 16*c* and the address data SAD, RAD and EAD stored in the parameter memory 17*a* have a large number of data bit, each one data is stored in two address positions. In this case, data of the least significant bit LSB is stored at the prior address position and the data of the most significant bit MSB is stored at the subsequent address position. For reasons of circuit design, the key code KC, tone color code VN and touch data TCH used as the address signals are changed to values which are double the original values by shifting these data by one bit towards the more significant bit side. When no addition is made to these values, data of the least significant bit LSB stored at the prior address position is read out. When "1" has been added to these values, the data of the most significant bit MSB at the posterior address is read out.

Figure 3:
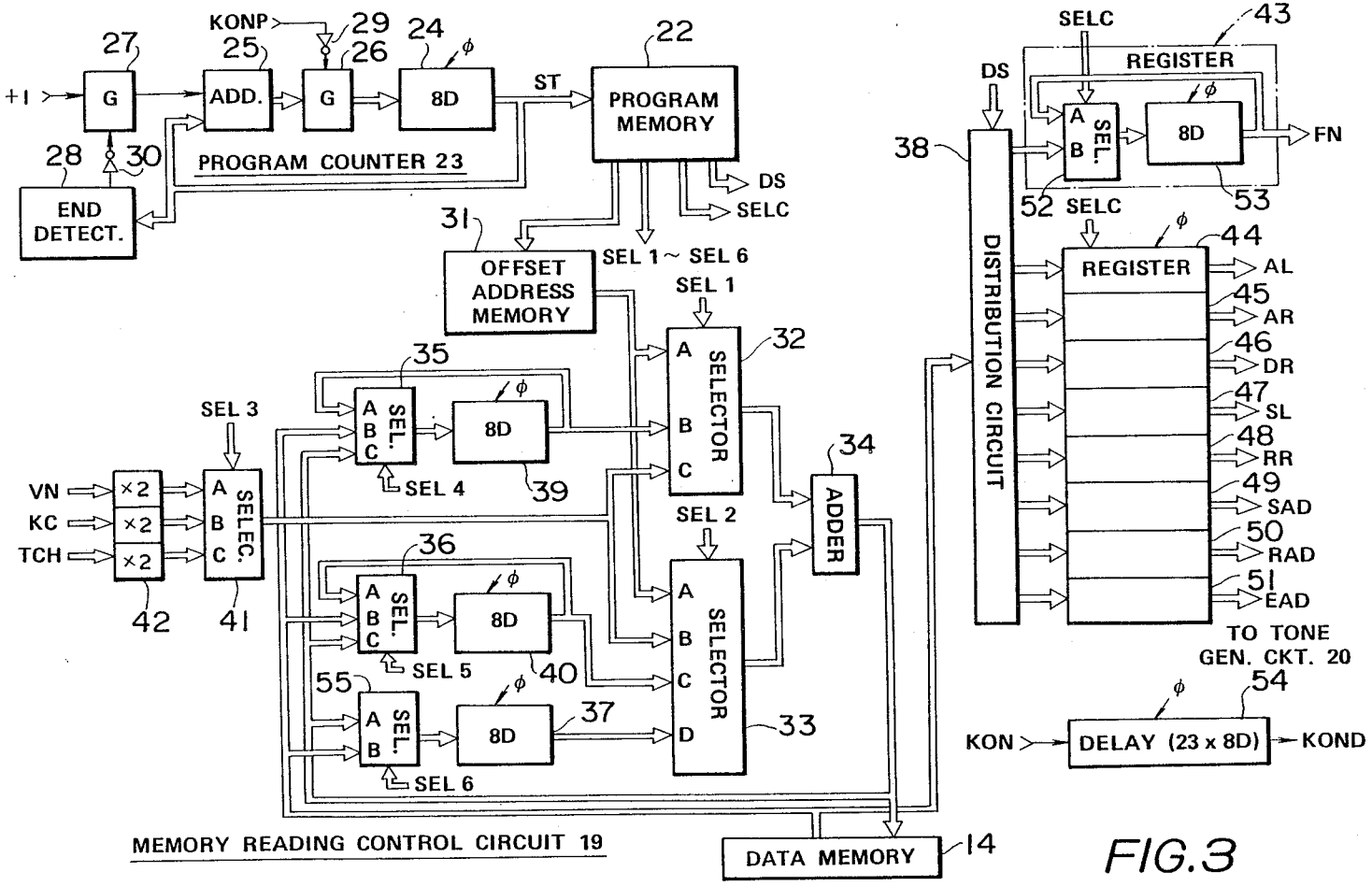
FIG. 3 is a block diagram showing a specific example of a memory reading control circuit in FIG. 1.

FIG. 3 shows a specific example of the memory reading control circuit 19. In this example, the reading control is effected by utilizing a microcomputer.

A program memory 22 stores a program for carrying out the reading control for the data memory 14. A program counter 23 produces a program step signal ST for accessing the program memory 22. The counter 23 comprises a shift register 24 of eight stages, an address 25, gates 26 and 27 and end detection circuit 28 and performs counting for eight channels on a time shared basis. The key-on pulse KONP is inverted by an inverter 29 and applied to a control input of the gate 26. This key-on pulse KONP becomes a signal "1" at the beginning of depression of the key and key-on pulses KONP corresponding to the respective channels are time-division multiplexed. The adder 25 adds "1" provided from the gate 27 to the output of the shift register 24. The result of the addition is applied to the shift register 24 through the gate 26. The end detection circuit 28 detects whether the value of the output of the shift register 24 has reached a final step of the program or not. If the value has not reached the final step yet, the end detection circuit 28 produces a signal "0" and supplies a signal "1" to a control input of the gate 27 through an inverter 30 thereby supplying a signal "1" indicating one count up to the adder 25. If the value has reached the final step, the end detection circuit 28 produces a signal "1" and supplies a signal "0" to the gate 27 through the inverter 30 thereby closing the gate 27 to prevent counting.

Owing to the above described construction, contents of the program counter 23, i.e., the step signal ST, are reset to "0" when the key-on pulse KONP has been generated and are counted up by one at each circulation (every eight time slots) of the shift register 24. The counting is stopped when the program has reached the final step. The number of the program steps is, for example, 24 and the step signal ST produced by the counter 23 is successively changed from "0" to "23" (final step). The step signal ST is the output of the shift register 24 and step signal sST for eight channels are time-division multiplexed.

The program memory 22 produces selection control signals SEL1-SEL6 and SELC and distribution control signal DS in accordance with the step of the applied step signal ST and also produces address data for accessing an offset address memory 31. The offset address memory 31 stores values of the above described offset address data OA1 and OA2 and various offset values "1", "2", "3" . . . The offset address data read out from the offset address memory 31 is applied to A-inputs of selectors 32 and 33. The outputs of the selectors 32 and 33 are added together by an adder 34 and the output of the adder 33 is applied to an address input of the data memory 14. The output of the adder 34 is also applied to a C-input of a selector 35, a C-input of a selector 36 and an A-input of a selector 55.

The data read out from the data memory 14 is applied to B-inputs of the selectors 35, 36 and 55 and a distribution circuit 38. The output of the selector 35 is applied to a shift register 39 of eight stages and the output of the shift register 39 is fed back to the A-input of the selector 35 and applied also to a B-input of the selector 32. The output of the selector 36 is applied to a shift register 40 of eight stages and the output of the shift register 40 is fed back to the A-input of the selector 36 and applied also to a C-input of the selector 33. The output of the selector 55 is applied to a shift register 37 of eight stages. The output of the shift register 37 is applied to a D-input of the selector 33. To a C-input of the selector 32 and a B-input of the selector 33 is applied output of a selector 41. To A, B and C inputs of the selector 41 are applied data derived by shifting the tone color code VN, the key code KC and touch data TCH by one bit towards the most significant bit by a doubling circuit 42. To selection control inputs of the selectors 32, 33, 41, 35, 36 and 55 are respectively applied selection control signals SEL1, SEL2, SEL3, SEL4, SEL5 and SEL6.

The distribution circuit 38 distributes data read out from the data memory 14 in parallel by kind of the data. The manner of distribution of data is controlled by a distribution control signal DS in accordance with the program execution step. Registers 43-51 are provided for storing and holding distributed data. The register 43 for the frequency number FN only is illustrated in detail but the other registers 44-51 are of the same construction. The respective registers 43-51 include a selector 52 and a shift register 53 of eight stages and control selection in the selector 52 by the selection control signal SELC. When new data is to be supplied from the distribution circuit 38, a B-input of the selector 52 is selected whereas when contents stored in the shift register 53 are circulatingly held, an A-input of the selector 52 is selected.

Parameter data FN, AL, AR, DR, SL, RR, SAD, RAD and EAD for eight channels stored in the registers 43-51 are provided on a time shared basis and supplied to the tone generation channel 20. A delay circuit 54 delays the key-on signal KON by a predetermined period of time and supplies a delayed key-on signal KOND to the tone signal generation circuit 20. This delay time corresponds to delay time due to the processing by the memory reading control circuit 19 (processing time for the 23 steps) and are provided for matching rise timing of the key-on signal KON with rise timing of output signals of the respective registers 43-51. A shift clock pulse $\phi$ of each shift register has a period corresponding to the time slot width of one channel time.

An example of contents of processing executed in each step will now be described.

[When ST=0: reading of FN on the LSB side]

The B-input of the selector 41 is selected by the selection control signal SEL3, the B-input of the selector 33 is selected by the selection control signal SEL2 and the key code KC (precisely speaking, a value which is double the original key code: hereinafter reference to the fact that values of KC, VN and TCH are all doubled will be omitted) is applied to the address input of the data memory 14 through the adder 34. Data of the LSB side of frequency number FN corresponding to the key code KC is thereby read out from the frequency number memory 15 (FIG. 2) in the data memory 14. The read out data is distributed to the register 43 for FN by the distribution circuit 38 and this data is loaded in bit positions of the LSB side of the shift register 53 in response to the selection control signal SELC.

[When ST=1: Reading of FN on the MSB side]

The offset value "1" is read out from the offset address memory 31, the A-input of the selector 32 is selected by the selection control signal SEL1 and this offset value "1" is applied to the adder 34. The B-input of the selector 41 is selected by the selection control signal SEL3, the B-input of the selector 33 is selected by the signal SEL2 and the key code KC is applied to the adder 34. The adder 34 adds the offset value "1" to the key code KC and applies its output to the data memory 14. Data of the MSB side of the frequency number FN corresponding to the key code KC is thereby read out from the frequency number memory 15 in the data memory 14. The read out data is distributed to the register 43 for FN and the data is loaded in the LSB side bit position of the shift register 53 through the B-input of the selector 52 while the data on the LSB side previously loaded is circulatingly held. Thus, the data of both MSB side and LSB side of the frequency number FN corresponding to the key code KC (i.e., all bits) are stored in parallel in the register 43. [When ST=2: Reading of the LSB side of VAD]

Data of the offset address OA1 is read out from the offset address memory 31, the A-input is selected by the signal SEL1 and the data OA1 is applied to the adder 34. The B-input is selected by the signal SEL2 and the A-input is selected by the signal SEL3, and the tone color code VN is applied to another input of the adder 34 through the selectors 41 and 33. The output of the adder 34 becomes OA1+VN which indicates an absolute address corresponding to the tone color code VN in the voice directory 16*a* in the data memory 14. Data of the LSB side of the voice address data VAD corresponding to the tone color code VN is thereby read out from the voice directory 16*a* in the data memory 14. The B-input of the selector 36 is selected by the selection control signal SEL5 is selected and read out data of the LSB side of the voice address data VAD is loaded in the bit position of the LSB side of the shift register 40.

[When ST=3: Reading of the MSB side of VAD]

The offset value OA1+1 which is the offset value OA1 added with 1 is read out from the offset address memory 31, the A-input is selected by the signal SEL1 and this OA1+1 is applied to the adder 34. The B-input is selected by the signal SEL2 and the A-input is selected by the signal SEL3, and the tone color code VN is applied to another input of the adder 34 through the selectors 41 and 33. The output of the adder 34 becomes OA1+VN+1 and data of the MSB side of the voice address data VAD corresponding to the tone color code VN is thereby read out from the voice directory 16*a* in the data memory 14. The B-input of the selector 36 is selected by the signal SEL5 and read out data of the MSB side of the voice address data VAD is loaded in the bit position of the MSB side of the shift register 40 while data of the LSB side which was previously loaded is circulatingly held through the A-input of the selector 36. In this manner, both the MSB side and the LSB side of the voice address data VAD corresponding to the tone color code VN (i.e., all bits) are stored in parallel in the shift register 40.

[When ST=4: Reading of the LSB side of KAD]

The C-input is selected by the signal SEL1, the B-input is selected by the signal SEL3 and the key code KC is supplied to the adder 34 through the selectors 41 and 33. In the selector 33, the voice address data VAD stored in the shift register 40 in the preceding step is selected through the C-input and supplied to the adder 34. The output of the adder 34 becomes VAD+KC whereby the data memory 14 is addressed in accordance with combination of the voice address data VAD corresponding to the key code VN and the key code KC and data of the LSB side of the key offset address data KAD corresponding to the key code KC is read out from the key offset address memory 16*b* in the voice memory corresponding to the voice address data VAD (any of VM1 - VMn in FIG. 2). The B-input of the selector 35 is selected by the signal SEL4 and read out data of the LSB side of VAD is loaded in the bit position of the LSB side in the shift register 39. The selector 36 is brought into state in which all bits of the A-input are selected by the signal SEL5 thereby holding the voice address data VAD in the shift register 40. The selector 55 is brought into a state in which the A-input is selected by the signal SEL6 thereby causing the address data VAD+KC to be loaded in the shift register 37.

[When ST=5: Reading of the MSB side of KAD]

The offset value "1" is read out from the offset address memory 31 and the A-input of the selector 32 is selected by the signal SEL1. The D-input of the selector 33 is selected by the signal SEL2 and the address data VAD+KC obtained in the preceding step is applied to the adder 34. The output of the adder 34 becomes VAD+KC+1 and data on the MSB side of the key offset address data KAD is thereby read out. The B-input of the selector 35 is selected by the signal SEL4 and read out data on the MSB side of the key offset address data KAD is loaded in a bit position on the MSB side of the shift register 39 while data on the LSB side which was previously loaded is circulatingly held through the A-input of the selector 35. In this manner, all bits of the key offset address data KAD corresponding to the tone color code VN and the key code KC are stored in parallel in the shift register 40. On the other hand, the voice address data VAD of the shift register 40 is held through the A-input of the selector 36.

[When ST=6: VAD+KAD]

The B-input of the selector 32 is selected by the signal SEL1 and the key offset address data KAD is applied to the adder 34. The C-input of the selector 33 is selected by the signal SEL2 and the voice address data VAD is applied to the adder 34 to obtain VAD+KAD. All bits of the C-input of the selector 35 are selected by the signal SEL4 and VAD+KAD is loaded in the shift register 39.

[When ST=7]

The offset data OA2 is read out from the offset address memory 31 and the A-input of the selector 32 is selected by the signal SEL1. The C-input of the selector 33 is selected by the signal SEL2 and the voice address data VAD of the shift register 40 is applied to the adder 34. The output of the adder 34 becomes VAD OA2 which indicates the initial address of the touch offset address memory 16*c* (FIG. 2) in an absolute address. The C-input of the selector 36 is selected by the signal SEL5 and VAD+OA2 is loaded in the shift register 40. On the other hand, all bits of the A-input of the selector 35 are selected by the signal SEL4 and VAD+KAD obtained in the preceding step is held.

[When ST=8: Reading of the LSB side of TAD]

The signals SEL3, SEL1 and SEL2 respectively select the C-input and the touch data TCH and the absolute address data VAD+OA2 are added together in the adder 34. The address input signal to the data memory 14 becomes VAD+OA2 . TCH and the data memory 14 is addressed in accordance with combination of the voice address data VAD corresponding to the tone color code VN and the touch data TCH and data on the LSB side of the touch offset address data TAD corresponding to the touch data TCH is thereby read out from the touch offset address memory 16*c* in the voice memory (any of VM1-VMn in FIG. 2) corresponding to the voice address data VAD. The B-input of the selector 55 is selected by the signal SEL6 and the data on the LSB side of TAD read out from the data memory 14 is loaded in the shift register 37. The signals SEL4 and SEL5 both select the A-input thereby causing VAD+KAD and VAD+OA2 to be held respectively.

[When ST=9: LSB of VAD+KAD TAD]

The signal SEL1 selects the B-input, the signal SEL2 selects the D-input and addition of VAD+KAD and data on the LSB side of TAD is made in the adder 34. By selecting all bits of the C-input of the selector 35 by the signal SEL4, result of the addition (VAD+KAD+data on the LSB side of TAD) is loaded in the shift register 39. The signal SEL5 selects the A-input thereby causing VAD+OA2 to be held.

[When ST=10]

In the same manner as in the case of ST=8, the C-input is selected respectively by the signals SEL1, SEL2 and SEL3 and VAD+OA2+TCH is obtained by the adder 34. The A-input of the selector 55 is selected by the signal SEL6 and VAD+OA2+TCH is loaded in the shift register 37. The signals SEL4 and SEL5 both select the A-input thereby causing "VAD+KAD+data on the LSB side of TAD" and "VAD+OA2" to be held respectively. [ST=11: Reading of the MSB side of TAD]

The offset value "1" is read out from the offset address memory 31, the A-input is selected by the signal SEL1 and the D-input is selected by the signal SEL2. The output of the adder 34 thereby becomes VAD+OA2+TCH+1 and data on the MSB side of the touch offset address data TAD corresponding to the touch data TCH is read out from the corresponding touch offset address memory 16c in the data memory 14. The B-input of the selector 55 is selected by the signal SEL6 and data on the MSB side of TAD is loaded in the shift register 37. The signals SEL4 and SEL5 both select the A-input causing the state of the preceding step to be held. [When ST=12: Reading of VAD+KAD-TAD: AL]

The signal SEL1 selects the B-input and the signal SEL2 selects the D-input and the adder 34 adds "VAD+KAD+data on the LSB side of TAD" and "data on the MSB side of TAD" together. In this manner, a signal "VAD+KAD+TAD" which is a result of addition of all address data corresponding to all parameter determining factors is obtained. This signal indicates, in an absolute address, the initial address of one of the data banks (DB1-DBm in FIG. 2)in which a set of parameter data corresponding to the color code VN, key code KC and touch data TCH is stored. The attack level data AL (see FIG. 2) stored at the initial address of this data bank is read out from the data memory 14 in response to the address signal VAD+KAD TAD provided by the adder 34. The distribution circuit 38 performs control so that this data AL is distributed to the register 44 for AL which takes in the data AL in response to the selection control signal SELC. Further, the C-input is selected by the signal SEL4 and the initial address signal VAD+KAD+TAD is loaded in the shift register 39.

[When ST=13-22: Reading of AR-RED]

In the step of ST=13-22, the signal SEL1 selects the B-input, the signal SEL2 the A-input and the signal SEL4 the A-input respectively. Accordingly, the initial address signal VAD+KAD+TAD in the shift register 39 is held and this data is added with the offset value read out from the offset address memory 31. A signal "1" is read out from the offset address memory 31 when ST=13 and subsequently an offset value which increases by 1 at each advance of the step (i.e., "2" when ST=14 and "10" when ST=22) is read out. Accordingly, an address signal which sequentially increases by 1 from the initial address VAD+KAD+TAD is supplied to the data memory 14 whereby the parameter data AR, DR, SL, RR, SAD, RAD and EAD in the data bank are sequentially read out at each step. Since, however, the waveshape data SAD, RAD and EAD are respectively stored in two address positions in a split form, data on the LSB side is read out at a first step and data on the MSB side is read out at a next step. In synchronism with reading of the data AR-EAD, the distribution circuit 38 distributes the data to corresponding registers 45-51. In the register 45-51, the distributed data are loaded. In the same manner as in the register 43, the registers 49, 50 and 51 perform processings for loading the data on the LSB side and the data on the MSB side in parallel.

[When ST=23: Finish]

The programming counter 23 is stopped and the parameter reading sequence is finished.

The contents and order of processings in the respective steps in the memory reading control circuit 19 have been described only by way of example and they can be changed as desired.

The tone generation circuit 20 comprises other circuits including a circuit for forming an address signal for accessing the waveshape data memory 18a and a circuit for multiplying a tone signal corresponding to tone signal waveshape data read out from the waveshape data memory 18a with an envelope shape signal. The tone generation circuit 20 generates tone signals for the respective channels on a time shared basis in accordance with the parameter data FN, AL, AR, DR, SL, RR, SAD, RAD and EAD supplied from the registers 43-51 in the control circuit 19 and the delayed key-on signal KOND supplied from the delay circuit 54.

An address signal forming circuit first generates, upon rising of the delayed key-on signal KOND to "1", an address signal which sequentially changes from a start address represented by the address data SAD to an end address represented by the address data EAD at a speed corresponding to the frequency number FN. Upon reaching of this address signal to the end address (EAD), the address signal forming circuit repeatedly generates an address signal which sequentially changes from a repeat address represented by the address data RAD to the end address (EAD) at a speed corresponding to the frequency number FN. An envelope shape signal generation circuit generates, in response to the delayed key-on signal KOND, an envelope shape signal (ADSR shape) whose attack level, attack time, decay time, sustain level and release time are established by the parameter data AL, AR, DR, SL and RR.

Since the address signal produced by the address signal forming circuit is supplied to the data memory 4, tone waveshape data (tone waveshape sampled values) stored at an address designated by the address signal in the waveshape data memory 18a in the data memory 14 is read out. The read out tone waveshape data is supplied to the tone generation circuit 20 where it is multiplied with the envelope shape signal and thereafter is supplied to the sound system 21. Thus, the tone generation circuit 20 generates tone signals corresponding to the parameter data AL, AR, . . . EAD for the respective channels.

In the above described embodiments, both the tone color control (key scaling of the tone color) in accordance with the tone pitch (or tone range) and the tone color control in accordance with the key touch can be realized. An arrangement may be made so that either one of these controls only can be performed. In this case, either the key offset address memory 16b or the touch offset address memory 16c may be omitted. The tone color may be controlled in accordance with other factor (such, for example, as operation element information concerning an operation element such as a brilliance operation knob). In this case, an address memory corresponding to this factor is provided in the bank directory BDR.

In the above described embodiment, the address memories are constructed in such a manner that they are dependent upon respective tone color kinds (voice) using tone color kinds which can be selected by the tone color selection circuit as the basis. This dependency (hierarchy) may however be reversed. For example, the tone range may be taken as the basis and address memories corresponding to respective tone colors and key touches may be constructed in such form as they depend upon the respective tone ranges.

The kind of the parameter data stored in the parameter memory is not limited to the above described parameters for forming an envelope shape (AR-RR) and the parameters for designating a tone waveshape (SAD - EDA) but it may include any other parameters such as filter parameter, harmonic coefficient parameter, modulation effect parameter and FM or AM modulation operation parameter.

The waveshape to be stored in the waveshape memory is not limited to the above described waveshape of plural periods but it may be a waveshape of one period or half period.

This invention is applicable also to a device which adopts a waveshape readout system according to which, as disclosed in Japanese Preliminary Patent Publication No. 147793/1985, (Corresponding U.S. Pat. No. 4,633,749) the waveshape to be read out repeatedly is changed as time goes by. The invention is applicable also to a device which adopts, as disclosed in Japanese Preliminary Patent Publication No. 55398/1985, different waveshapes are interpolated and synthesized in accordance with touch or tone pitch (tone range).

What is claimed is:

1. A parameter supply device in an electronic musical instrument comprising:

information generating means for generating first information and second information, a combination of said first information and said second information determining a characteristic of a tone to be produced by said electronic musical instrument;

memory means for storing plural parameters each of which corresponds to said combination and represents said characteristic, said memory means being divided into plural locations each of which is specified by said combination and stores a parameter corresponding to said combination among said plural parameters;

address generating means for storing plural addresses and for outputting a first address corresponding to said first information from among said plural addresses;

calculation means for performing a calculation with said first address and said second information and for outputting a second address based on the calculation result, said second address designating a location in said memory means; and read out means for reading out the parameter stored at the location designated by said second address, said characteristic being determined by the read out parameter.

2. A parameter supply device as defined in claim 1 wherein said electronic musical instrument has a keyboard having plural keys designating a tone pitch and said first information is information representing a tone color, a tone pitch or key depression degree of said tone to be produced.

3. A parameter supply device as defined in claim 1 wherein said electronic musical instrument has a keyboard having plural keys designating a tone pitch and said second information is information representing a tone color, a tone pitch or a key depression degree of said tone to be produced.

4. A parameter supply device in an electronic musical instrument comprising: parameter memory means for storing plural sets of parameters in correspondence to plural sets of combinations of parameter determining factors;

address memory means provided for each of said parameter determining factors for storing address data individually in correspondence to each parameter determining factor; and operation means, capable of operating on address data read out from said address memory means individually in correspondence to each parameter determining factor, for forming an address signal corresponding to a combination of parameter determining factors and reading out a set of parameters from said parameter memory means in response to this address signal;

wherein address data stored in a portion of said address memory means corresponding to at least one parameter determining factor is read out in accordance with a combination of said at least one parameter determining factor and data corresponding to at least another parameter determining factor.

5. A parameter supply device as defined in claim 4 wherein said address memory means comprises:

first address memory means storing first address data in correspondence to a first parameter determining factor; and second address memory means storing second address data in correspondence to combination of first and second parameter determining factors, said second address data is data representing a relative address for said first address data, and said operation means performs addition or subtraction with respect to the first address data read out from said first address memory means in correspondence to the first parameter determining factor and the second address data read out from said second address memory means in correspondence to combination of data corresponding to the first parameter determining factor and the second parameter determining factor thereby forming said address signal corresponding to combination of the first and second parameter determining factors.

6. A parameter supply device as defined in claim 5 wherein said address memory means further comprises third address memory means storing third address data in correspondence to combination of first and third parameter determining factors, said third address data being data representing a relative address for the second address data, and said operation means adds to or subtracts from result of operation between the first address data and the second address data the third address data read out from said third address memory means in correspondence to combination of data corresponding to the first parameter determining factor and the third parameter determining factor thereby forming the address signal corresponding to combination of the first, second and third parameter determining factors.

7. A parameter supply device as defined in claim 5 wherein said second address memory means provides the second address data in correspondence to combination of the first address data read out from said first address memory means in correspondence to the first parameter determining factor and the second parameter determining factor.

8. A parameter supply device as defined in claim 6 wherein said third address memory means provides the third address data in correspondence to combination of the first address data read out from said first address memory means in correspondence to the first parameter determining factor and the third parameter determining factor.

9. A parameter supply device as defined in claim 5 wherein said address memory means further comprises third address memory means storing third address data in correspondence to combination of second and third parameter determining factors, said third address data being data representing a relative address for the second address data, and said operation means further adds to or subtracts from result of operation between the first address data and the second address data the third address data read out from said third address memory means in correspondence to combination of the first parameter determining factor and the third parameter determining factor thereby forming the address signal corresponding to the first and third parameter determining factors.

10. A parameter supply device as defined in claim 9 wherein said third address memory means provides the third address data in correspondence to combination of the second address data read out from said second address memory means and the third parameter determining factor.

11. A parameter supply device as defined in claim 4 wherein said parameter determining factors are tone color kind, tone pitch and key touch.

* * * * *